US009280107B2

(12) United States Patent
Hasegawa et al.

(10) Patent No.: US 9,280,107 B2
(45) Date of Patent: Mar. 8, 2016

(54) FIXING DEVICE AND IMAGE FORMING APPARATUS INCLUDING SAME

(71) Applicants: Motokazu Hasegawa, Kanagawa (JP); Yukari Isoe, Kanagawa (JP); Susumu Matsusaka, Kanagawa (JP)

(72) Inventors: Motokazu Hasegawa, Kanagawa (JP); Yukari Isoe, Kanagawa (JP); Susumu Matsusaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 14/152,057

(22) Filed: Jan. 10, 2014

(65) Prior Publication Data

US 2014/0205333 A1 Jul. 24, 2014

(30) Foreign Application Priority Data

Jan. 21, 2013 (JP) ..... 2013-008252

(51) Int. Cl.
*G03G 15/20* (2006.01)

(52) U.S. Cl.
CPC .... *G03G 15/2053* (2013.01); *G03G 2215/2032* (2013.01)

(58) Field of Classification Search
USPC ..... 399/329
See application file for complete search history.

(56) References Cited

U.S. PATENT DOCUMENTS

| | | | | |
|---|---|---|---|---|
| 8,270,887 | B2 * | 9/2012 | Uchiyama et al. | 399/329 |
| 9,098,029 | B2 * | 8/2015 | Ueno | G03G 15/2039 |
| 2004/0169036 | A1 * | 9/2004 | Katakabe | G03G 15/2053 219/619 |
| 2005/0152720 | A1 * | 7/2005 | Katakabe | G03G 15/2053 399/330 |
| 2006/0285893 | A1 | 12/2006 | Ishii | |
| 2007/0014599 | A1 * | 1/2007 | Yasuda et al. | 399/328 |
| 2009/0269109 | A1 * | 10/2009 | Ishida et al. | 399/330 |
| 2009/0290916 | A1 * | 11/2009 | Baba | G03G 15/2007 399/329 |
| 2009/0290917 | A1 * | 11/2009 | Baba | G03G 15/2064 399/329 |
| 2010/0061753 | A1 * | 3/2010 | Hase | 399/69 |
| 2012/0155933 | A1 | 6/2012 | Hasegawa et al. | |
| 2012/0177418 | A1 | 7/2012 | Hashiyada et al. | |
| 2012/0230743 | A1 | 9/2012 | Matsusaka et al. | |
| 2014/0219694 | A1 * | 8/2014 | Matsusaka et al. | 399/329 |
| 2014/0241764 | A1 * | 8/2014 | Hasegawa et al. | 399/328 |
| 2014/0305925 | A1 * | 10/2014 | Oka et al. | 219/216 |

FOREIGN PATENT DOCUMENTS

| | | |
|---|---|---|
| JP | 2002-270356 | 9/2002 |
| JP | 2003-215957 | 7/2003 |
| JP | 2006-350054 | 12/2006 |
| JP | 2008-032944 | 2/2008 |
| JP | 2009-014972 | 1/2009 |
| JP | 2009-216751 | 9/2009 |

(Continued)

*Primary Examiner* — David Gray
*Assistant Examiner* — Geoffrey Evans
(74) *Attorney, Agent, or Firm* — Oblon, McClelland, Maier & Neustadt, L.L.P.

(57) ABSTRACT

A fixing device includes a rotary fixing member; a pressure roller pressed against the fixing member to form a nip in association with the fixing member; and an induction heater, as a heat source, to heat the fixing member. The induction heater includes an excitation coil to induction-heat the fixing member; a side core disposed along an outer circumference in a longitudinal direction of the excitation coil; and a plurality of arch-shaped cores disposed to cover the excitation coil in the longitudinal direction thereof. The arch-shaped cores include center portions corresponding to an inner side of the excitation coil and bent to the fixing member; and outer end portions extending in the direction leading to the side core without interfering with the excitation coil.

12 Claims, 11 Drawing Sheets

(56) References Cited

FOREIGN PATENT DOCUMENTS

| | | |
|---|---|---|
| JP | 2010-204265 | 9/2010 |
| JP | 2012-008263 | 1/2012 |
| JP | 2012-063791 | 3/2012 |
| JP | 2012-141589 | 7/2012 |
| JP | 2012-159829 | 8/2012 |
| JP | 2012-198493 | 10/2012 |

* cited by examiner

PRESENT EMBODIMENT

COMPARATIVE EXAMPLE

EMBODIMENT 1

EMBODIMENT 2

FIXING DEVICE AND IMAGE FORMING APPARATUS INCLUDING SAME

CROSS-REFERENCE TO RELATED APPLICATION

The present application claims priority pursuant to 35 U.S.C. §119 from Japanese patent application number 2013-008252, filed on Jan. 21, 2013, the entire disclosure of which is incorporated by reference herein.

BACKGROUND

1. Technical Field

The present invention relates to a fixing device employing an electromagnetic induction heating method, and to an image forming apparatus incorporating such a fixing device.

2. Related Art

Conventionally, an image forming apparatus such as a copier, a printer, and the like, includes a fixing device employing electromagnetic induction, which is both fast and energy-efficient.

For example, JP-2006-350054-A discloses a fixing device employing the electromagnetic induction heating method, which includes a support roller as a heat roller to generate heat, a fixing support roller as a fixing roller, a fixing belt stretching around the support roller and the fixing support roller, an induction heater disposed opposite the support roller via the fixing belt, and a pressure roller pressing against the fixing support roller via the fixing belt.

The induction heater is formed of a coil such as an excitation coil wound in the longitudinal direction and a core disposed opposite the coil. The fixing belt is configured to be heated at a portion opposite the induction heater. The thus-heated fixing belt heats to fix a toner image formed on a recording medium conveyed to a position opposite the fixing support roller and the pressure roller. More specifically, when a high frequency alternating current is supplied to the coil, an alternate magnetic field is formed around the coil, and an eddy current is generated near the surface of the support roller. When the eddy current is generated to the support roller as a heat roller, joule heat is generated by the electrical resistance of the support roller itself and the fixing belt wound around the support roller is heated.

The fixing device employing the electromagnetic induction heating method as described above has better thermal conversion efficiency and thus consumes less energy than a conventional halogen heater, and is capable of increasing a surface temperature of the fixing belt up to a prescribed level in a short time because a heat generator used in the electromagnetic induction fixing device is directly heated.

A coil used for the induction heating includes an excitation coil and a core to introduce alternate magnetic field generated by the excitation coil to the heat generator. The fixing device disclosed by JP-2008-032944-A includes a flux path by using cores 28, 29 from the excitation coil 25 to the fixing roller 20 including the heat generator.

As illustrated in FIGS. 2 and FIGS. 4A and 4B, the core 29 is divided into four parts A to D that are arranged around the circumference of the excitation coil with a minimum length, so that any leakage of the magnetic flux from the excitation coil is minimized and thermal efficiency is improved.

In addition, JP-2003-215957-A (or JP3452920) discloses a fixing device in which the excitation coil 5 is surrounded by the cores 32, 33, and 38 (see FIG. 16).

However, dividing the core as described above causes the magnetic flux to leak from joint portions between adjacent cores, thereby reducing heat generation efficiency. In addition, segmentation of the core increases the number of parts, resulting in a cost rise.

As an approach to the above disadvantage, provision of a gap between all arch-shaped cores and side cores is conceived to afford a unified contact status to reduce temperature fluctuation in the longitudinal direction due to dimensional variations of the opening. In this case, decrease in the heat generation efficiency cannot be prevented.

In addition, JP-2009-216751-A discloses a structure in which both side ends of the arch-shaped cores are bent in the direction to the heat generator. Specifically, FIG. 19 corresponds to FIG. 2 of the above patent literature. As illustrated in FIG. 19, both ends of the arch cores 54 are bent toward the heat roller 46, a heat generator.

In such a structure, heat rises at opposed surfaces of the heat generator, i.e., a front end of the bent portions of the arch-shaped cores, and therefore it is difficult to maintain a uniform temperature distribution along the axial direction of the roller or the coil longitudinal direction.

In addition, the excitation coil needs to be held in the arch-shaped core. However, the disclosed structure with both ends bent is unsuitable for mounting the arch-shaped cores from above the coil because bent portions at both ends interfere with the coil.

SUMMARY

The present invention solves the above problem in the fixing device employing the induction heating method, and provides a fixing device that includes a rotary fixing member; a pressure roller pressed against the fixing member to form a nip in association with the fixing member; and an induction heater, as a heat source, to heat the fixing member. The induction heater includes an excitation coil to induction-heat the fixing member; a side core disposed along an outer circumference in a longitudinal direction of the excitation coil; and a plurality of arch-shaped cores disposed to cover the excitation coil in the longitudinal direction thereof. The arch-shaped cores include center portions corresponding to an inner side of the excitation coil and bent to the fixing member; and outer end portions extending in the direction leading to the side core without interfering with the excitation coil.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

Figure 1:
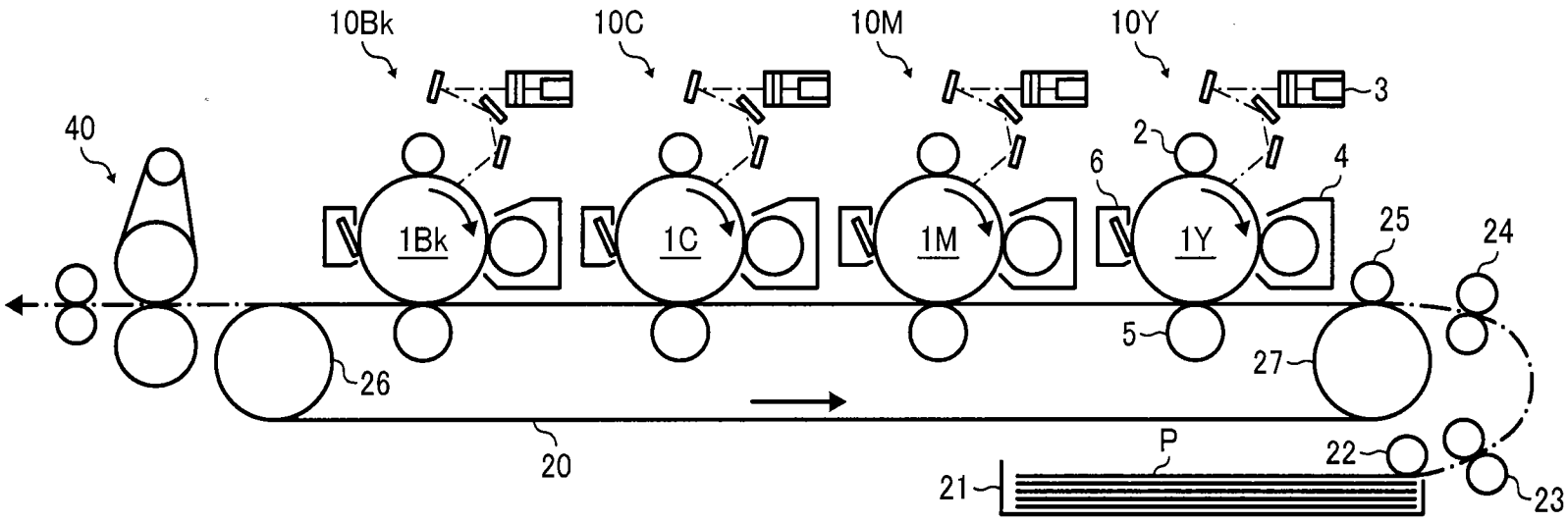
FIG. 1 illustrates a schematic structure of an image forming apparatus including a fixing device according to an embodiment of the present invention.

FIG. 1 is a schematic cross-sectional view of an image forming apparatus including a fixing device according to an embodiment of the present invention. Hereinafter, a structure and operation of the image forming apparatus will be described with reference to FIG. 1.

The image forming apparatus is a printer that employs an electrophotographic method and includes four sets of image forming units 10Y, 10M, 10C, and 10Bk, each mainly including photoreceptor drums 1Y, 1M, 1C, and 1Bk as an image carrier, so that a full-color image using four colors of toner, yellow (Y), magenta (M), cyan (C), and black (Bk) can be formed. However, the structure of the image forming apparatus is not limited to the illustrated example alone. For example, the illustrated printer herein employs a direct transfer method, in which a toner image is directly transferred onto a recording medium such as a sheet; however, the printer may employ an indirect transfer method, in which the toner image is transferred to the sheet via an intermediate transfer member. In addition, the number or order of colors can be varied. Further, the present invention is not limited to a printer but is applicable to, a copier, a facsimile machine, or a multi-function apparatus having one or more capabilities of the above devices.

As illustrated in FIG. 1, the four sets of image forming units 10Y, 10M, 10C, and 10Bk are disposed in parallel along an upper surface of a conveyance belt 20, to thus form a tandem-type image forming section. The conveyance belt 20 is stretched around a driving roller 26 and a driven roller 27 and rotates in the direction of the arrow in the figure. A paper tray 21 to contain a sheet P as a recording medium is disposed beneath the conveyance belt 20. The sheet P fed from a sheet feed roller pair 22 is conveyed by conveyance roller pairs 23, 24 guided by a guide member, not shown, and is conveyed. The thus-conveyed sheet P is then fed to an upper surface of the conveyance belt 20 through an inlet portion where a bias roller 25 is disposed opposite the driven roller 27 and is conveyed by being electrostatically attracted to the conveyance belt 20. Then, toner images are sequentially transferred from the image forming units 10Y, 10M, 10C, and 10Bk in the tandem image forming section to the sheet P that is conveyed by the conveyance belt 20. The sheet carrying an unfixed toner image thereon is conveyed from the conveyance belt 20 to a fixing device 40, and the fixing device 40 fixes the toner image onto the sheet with heat and pressure.

The four sets of image forming units 10Y, 10M, 10C, and 10Bk each are similar in structure. Therefore, the image forming unit 10Y disposed most upstream is taken as a representative and is described in detail below. To avoid complication, reference numerals for the image forming units 10M, 10C, and 10Bk other than the yellow image forming unit 10Y are omitted. In addition, suffixes representing different colors Y, M, C, and Bk will be omitted in the explanation below.

Each image forming unit 10 includes a photoreceptor drum 1 disposed in the center and rotatably contacting the conveyance belt 20. Around a circumference of the photoreceptor drum 1 are disposed a charger 2, an exposure device 3, a developing device 4, a transfer roller 5, a cleaner 6, and a discharge lamp, not shown, in this order along a rotation direction of the photoreceptor drum 1. The charger 2 charges a surface of the photoreceptor drum 1 so that the photoreceptor drum 1 has a predetermined electric potential. The exposure device 3 exposes the charged drum surface based on color-decomposed image signals and forms an electrostatic latent image on the surface of the drum. The developing device 4 supplies toner to develop the electrostatic latent image formed on the drum surface and renders the latent image visible. The transfer roller 5 transfers the developed toner image on the sheet conveyed via the conveyance belt 20. The cleaner 6 removes residual toner remaining, without being used in the transfer, on the surface of the drum. The discharge lamp, not shown, removes any electrical charge remaining on the surface of the drum.

Next, the fixing device according to an embodiment of the present invention will be described with reference to FIG. 2.

Figure 2:
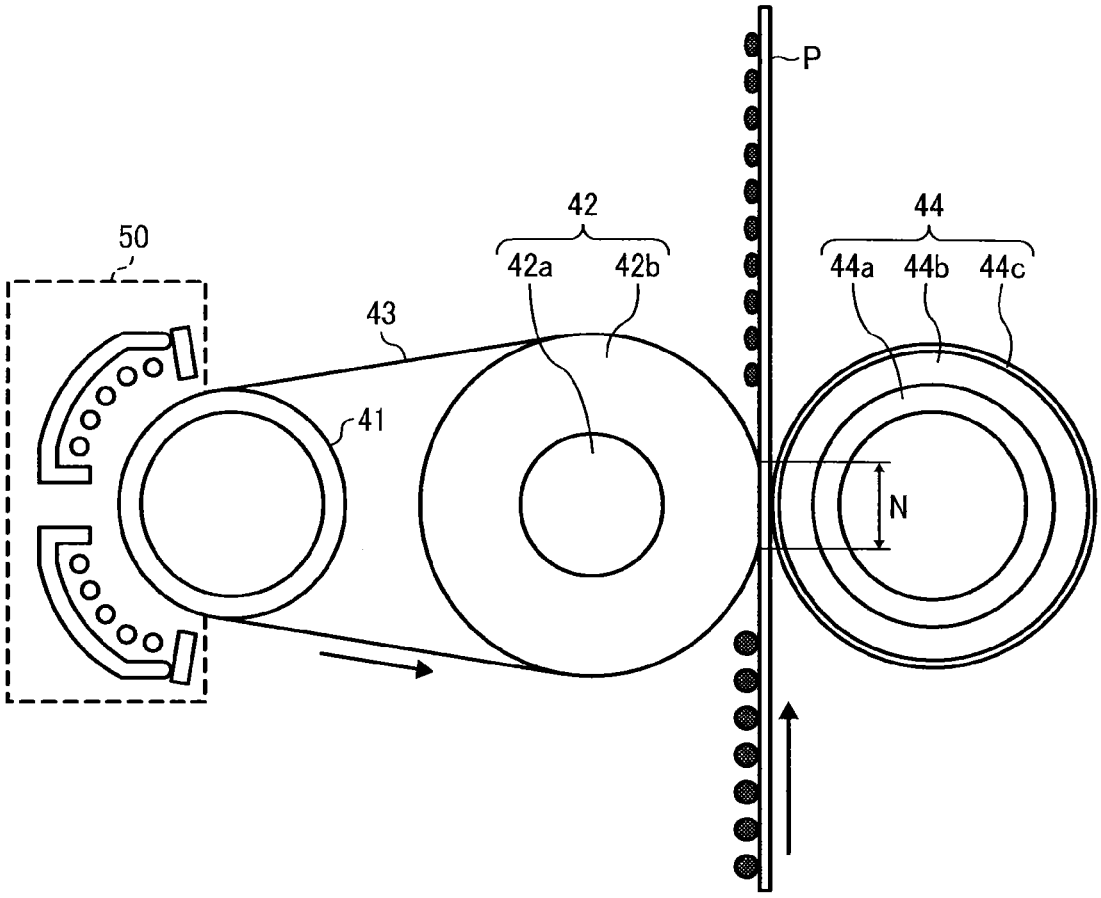
FIG. 2 illustrates a cross-sectional view of the fixing device according to an embodiment of the present invention.
Figure 3:
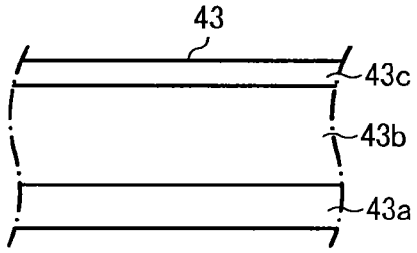
FIG. 3 is a cross-sectional view illustrating a structure of a fixing belt.

FIG. 2 is a schematic cross-sectional view of the fixing device employing induction heating method, which can be used as the fixing device 40 in the printer schematically illustrated in FIG. 1. As illustrated in FIG. 2, the fixing device 40 includes a heat roller 41, a fixing roller 42, a fixing belt 43, a pressure roller 44, an induction heating unit 50, and the like.

The heat roller 41 includes a metal core formed of non-magnetic stainless steel, having a thickness of from 0.2 to 1.0 mm. The heat roller 41 includes a heat generation layer formed of Cu on the surface thereof, to thus improve the heat generation effect. In this case, Nickel coating is preferably applied on the surface of the Cu layer for preventing corrosion. In addition, in order to further improve the heat generation effect, a ferrite core can be disposed inside the heat roller.

Alternatively, any magnetic shunt alloy with a Curie point of approximately 160 to 220 degrees C. may be used. An aluminum material is disposed inside the magnetic shunt alloy, so that a temperature increase stops around the Curie point. Even when the magnetic shunt alloy is used for the heat roller, a Cu coating layer is formed on the surface of the heat roller, so that the heat generation effect can be improved.

The fixing roller 42 includes a metal core 42*a* formed of, for example, stainless steel, carbon steel, or the like, and an elastic material 42*b* covering the metal core with solid or foamed silicon rubber having heat resistivity. Then, the pressure roller 44 presses against the fixing roller 42, so that a contact portion, that is, a fixing nip N, with a predetermined width is formed between the pressure roller 44 and the fixing roller 42. An external diameter of the fixing roller 42 is from 30 to 40 mm, the thickness of the elastic material 42*b* is from 3 to 10 mm, and the roller hardness is from 10 to 50 degrees according to Japanese Industrial Standards Class A (JIS-A).

The fixing belt 43 serving as a fixing member is stretched around the heat roller 41 and the fixing roller 42. The fixing belt 43 according to the present embodiment includes a base 43*a*, an elastic layer 43*b*, and an outer release layer 43*c*. The elastic layer 43*b* and the release layer 43*c* are laminated on the base 43*a*.

Properties required for the base 43*a* include mechanical strength required when stretched around the rollers, flexibility, and heat resistivity capable of withstanding the fixing temperature. In the present invention, the base 43*a* to induction-heat the heat roller 41 is preferably formed of insulating heat-resisting resins, such as, polyimide, polyamideimide, polyetheretherketone (PEEK), polyethersulfone (PES), polyphenylene sulfide (PPS), fluorine resins, and the like. The thickness thereof is from 30 to 200 μm considering the thermal capacity and the strength.

The elastic layer 43*b* is provided to give flexibility to the surface of the belt so as to obtain a uniform image without uneven glossiness, and preferably has a rubber stiffness of 5 to 50 degrees (according to JIS-A), and a thickness ranging from 50 to 500 μm. In addition, preferable materials include silicon rubbers, fluorosilicon rubbers, and the like, for obtaining heat resistivity for the fixing temperature.

Materials used for the release layer 43*c* include fluorine resins such as: polytetrafluoroethylene (PTFE); tetrafluoroethylene-perfluoroalkyl vinylether copolymer (PFA); and tetrafluoroethylene-hexafluoropropylene copolymer (FEP), or mixture of these resins, or heat resistant resins dispersed with above resins.

When the elastic layer 43*b* is coated with the release layer 43*c*, toner can be released easily and paper dust can be prevented from sticking without using silicon oil and the like, and an oil-less structure is enabled. However, the resins having releaseability usually have no elasticity like a rubber material, so that if the thick release layer is formed on the elastic layer, elasticity of the belt surface forming the release layer is lost, thereby generating uneven glossiness in the output image. To balance the releaseability and the elasticity, the thickness of the release layer 43*c* is preferably ranging from 5 to 50 μm and is more preferably 10 to 30 μm.

In addition, if necessary, a primer or undercoat layer is disposed between adjacent layers. Further, a layer to improve durability against slidable movement can be disposed on an interior surface of the base 43*a*.

The base 43*a* may include a heat generation layer. For example, the one in which a Cu layer having a thickness of 3 to 15 μm is formed on the base layer formed of polyimide can be used as a heat generation layer.

The pressure roller 44 is formed of a release layer 44*c*, an elastic layer 44*b* having a high heat resistance, and a metal core 44*a* including a metallic cylinder portion. The pressure roller 44 presses against the fixing roller 42 via the fixing belt 43, so that a fixing nip N is formed at the pressed portion. An outer diameter of the pressure roller is set to some 30 to 40 mm and the elastic layer 44*b* has a layer thickness of 0.3 to 5 mm and has an Asker stiffness of 20 to 50 degrees. A favorable material for the pressure roller 44 is silicon rubber because of necessity of heat resistance. Further, in order to improve releaseability when duplex printing is performed, the release layer 44*c* formed of fluorine resins and having a layer thickness of 10 to 100 μm is disposed on the elastic layer 44*b*.

Because the stiffness of the pressure roller 44 is greater than that of the fixing roller 42, the pressure roller 44 bites into the fixing roller 42 and the fixing belt 43. As a result, the recording medium that is conveyed along the fixing belt 43 is distorted on the way out of the fixing nip and has a curvature relative to the surface of the fixing belt 43, and thus, the releaseability of the recording medium is increased.

Figure 4A:
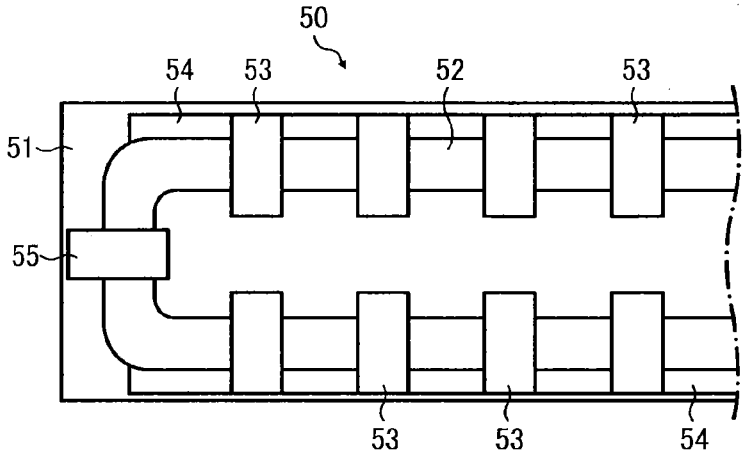
FIGS. 4A and 4B each illustrate an induction heating unit according to a first embodiment of the present invention.
Figure 4B:
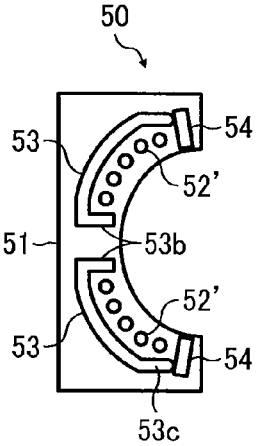

FIGS. 4A and 4B are views each illustrating a structure of the induction heating unit 50. FIG. 4A illustrates a coil mounting portion of the induction heating unit 50 seen from above and FIG. 4B illustrates a cross-sectional view of the induction heating unit 50 seen from an axis of the heat roller 41.

As illustrated in FIGS. 4A and 4B, the induction heating unit 50 according to the present embodiment includes a case 51, an excitation coil 52 (or 52' and 52' in FIG. 4B), arch-shaped cores 53, side cores 54, and end cores 55. Cores are formed to surround the excitation coil 52 to thus form a magnetic flux path to the heat roller 41. As illustrated in FIG. 4B, the arch-shaped cores 53 extend along a circumference of the roller if seen from the axial direction of the heat roller 41 and are disposed at intervals along the longitudinal direction of the heat roller 41. Accordingly, temperature distribution in the longitudinal direction of the heat roller 41 becomes uniform.

The excitation coil 52 is formed such that 50 to 500 electrical leads or wire strands each having a diameter of approximately 0.05 to 0.2 mm are wound together to form a litz wire, which is wound around 5 to 15 times. The litz wire includes a fusion layer on its surface thereof. The fusion layer is solidified by being heated electrically or heated in a constant temperature reservoir, and thus, the shape of the wound coil can be maintained. Alternatively, the litz wire without the fusion layer can be shaped by press molding. Because the litz wire requires a heat resistance in excess of the predetermined fixing temperature, preferable materials for an insulation coated layer of base wires include resins such as polyamideimide, polyimide, and the like having heat resistance and insulation properties.

If finished winding the coil 52, the coil 52 is attached to the case using a silicon adhesive or the like. The case 51 should be heat-resistant up to a temperature exceeding the fixing temperature and is preferably formed with highly heat-resistant resins such as PET or crystal liquid polymers.

Preferred materials for the cores 53, 54, 55 are ferrite ones such as Mn—Zn ferrite and Ni—Zn ferrite. The ferrite core is obtained by compressing and molding ferrite powder and by sintering the obtained ferrite mold. During sintering, the core shrinks. In particular, the opening of the arch-shaped core 53 is due to a difference in the shrinkage ratio between the opening portion and the connection portion thereof. As the arch-shaped core is large in size at the connection portion, the shrinkage ratio is greater, so that variations in shape are remarkable due to the shrinkage. As a result, production yield decreases, thereby increasing the cost for production. Considering the above, the arch-shaped cores 53 according to the present embodiment are formed in a compact size so as to cover one side of the wound coil 52.

Coil center portions 53*b* of the arch-shaped cores 53 are bent to the heat generating side, i.e., in the direction of the heat roller 41. With such a configuration, the magnetic flux generated from the coil 52 can be more efficiently led to the heat roller 41 serving as the heat generating member.

In addition, outer end portions 53*c* of the arch-shaped cores 53 are not bent to a side of the heat generating member, do not interfere with the coil 52 disposed inside the arch-shaped cores 53, and extend in the direction leading to the side cores 54. In the present embodiment, the outer end portions 53*c* extend substantially parallel to the coil center portions 53*b*; however, the portions 53*c* can retain the arch shape. With such a configuration, because the outer end portions 53*c* of the arch-shaped cores 53 extend in the direction toward the side cores 54 without interfering with the excitation coil, in assembling the induction heating unit 50, there is no interference of the end portions of the arch-shaped cores with the coil even when mounting the arch-shaped cores 53 to the coil 52 from above the coil 52 (i.e., from the left in FIG. 4B), thereby greatly facilitating assembly.

Figure 5A:
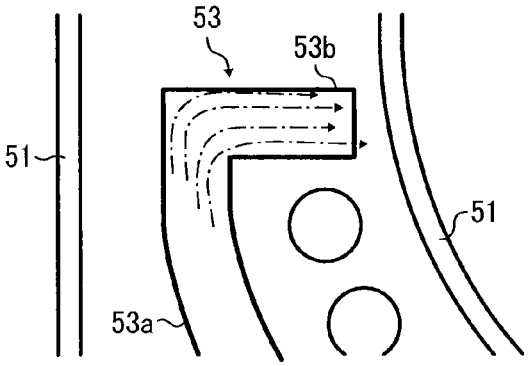
FIGS. 5A and 5B are schematic views illustrating an arch-shaped core.
Figure 5B:
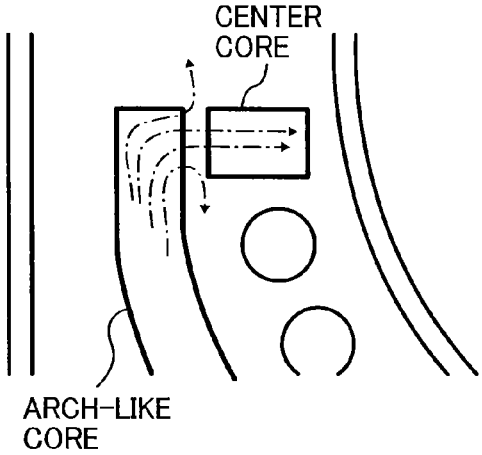

Referring to FIGS. 5A and 5B, the arch-shaped cores 53 will be described in greater detail comparing the present embodiment and a comparative example. In FIGS. 5A and 5B, each dot-dashed line with an arrow shows a magnetic flux.

As illustrated in FIG. 5B, the comparative example is configured such that the arch-shaped core and the center core are divided. A counter-magnetic flux is generated at a joint portion from the arch-shaped core to the center core, resulting in an occurrence of a leaked magnetic flux which is not transmitted between cores. By contrast, in the present embodiment as illustrated in FIG. 5A, the arch-shaped core 53 includes a continuous body formed of the arch-shaped portion 53*a* and the center portion 53*b*, so that the magnetic flux is not leaked and can be transmitted completely. As a result, the induction heating device with a heat generator or the heat roller 41 having higher heat generation efficiency can be obtained, thereby improving energy saving effect of the fixing device.

In the present embodiment, the side cores 54 include a planar surface and plural side cores 54 are disposed along the axial direction of the heat roller. Because the ferrite core shrinks through sintering process, the longer one tends to be warped. Therefore, plural cores are used to avoid warping. In addition, the side cores 54 are disposed up to a bent portion of the excitation coil 52, that is, a portion of the coil at a longitudinal end where the straight coil starts to be curved.

End cores 55 are disposed at both ends of the coil 52 to prevent reduction of heat at the end of the recording material passing through the nip and to increase temperature at the end. When the temperature at the nip is sufficiently uniform, provision of the end cores 55 can be omitted.

Next, the induction heating unit 50 will be described.

[First Embodiment]

Figure 6A:
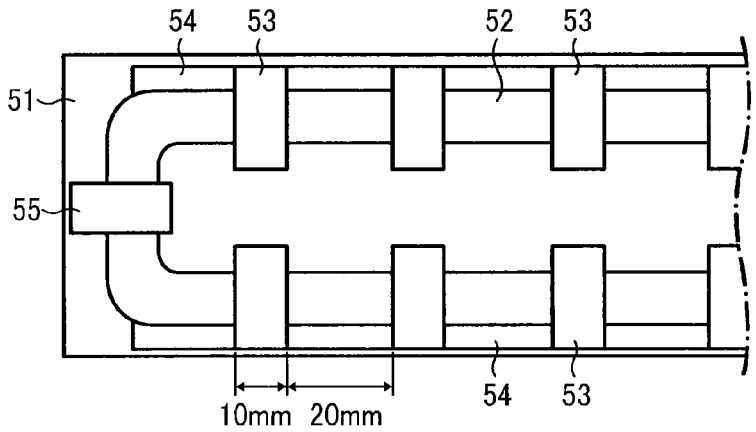
FIGS. 6A and 6B each illustrate an induction heating unit according to a second embodiment of the present invention.
Figure 6B:
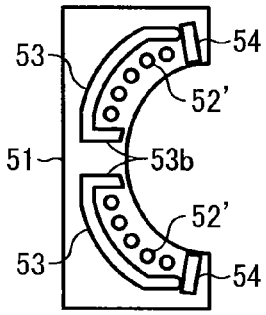

In the structure as illustrated in FIGS. 6A and 6B, the arch-shaped cores 53 are each formed to have a width of 10 mm, and are disposed at intervals of 20 mm in the longitudinal direction of the induction heating unit 50. The coil 52 employs litz wires formed such that 150 electrical leads having a diameter of 0.15 mm are wound together. In the present embodiment, the arch-shaped cores 53 are disposed at equal intervals; however, when the temperature of the both ends is remarkably low, the interval of the arch-shaped cores 53 disposed at the ends may be shortened.

[Second Embodiment]

Figure 7A:
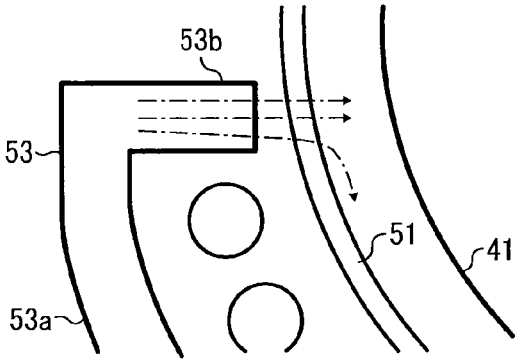
FIGS. 7A and 7B are schematic views illustrating a difference between the first and second embodiments.
Figure 7B:
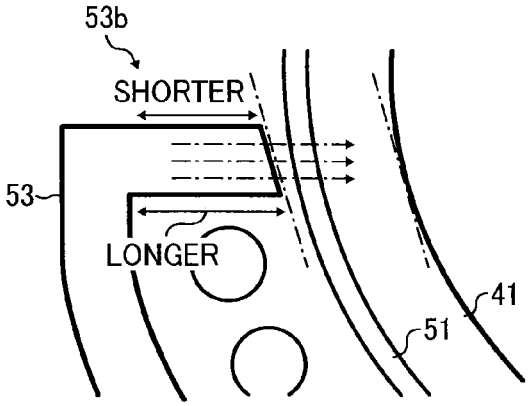

FIGS. 7A and 7B illustrate a second embodiment. In addition, FIG. 7(*b*) is an enlarged view illustrating difference of the second embodiment from the first embodiment. In the second embodiment, an end of the center portion 53*b* of the arch-shaped cores 53 is formed substantially parallel to a tangent line of the heat roller 41. The structure other than the above is the same as the first embodiment. FIGS. 7A and 7B illustrate flows of the magnetic fluxes in broken lines. It can be seen that, in the second embodiment as illustrated in FIG. 7B, the end of the coil center portions 53*b* approaches the heat generator so that the magnetic flux reaches the heat generator or the heat roller 41 more effectively, thereby reducing leaked magnetic flux and improving heat generation efficiency.

[Third Embodiment]

Figure 8A:
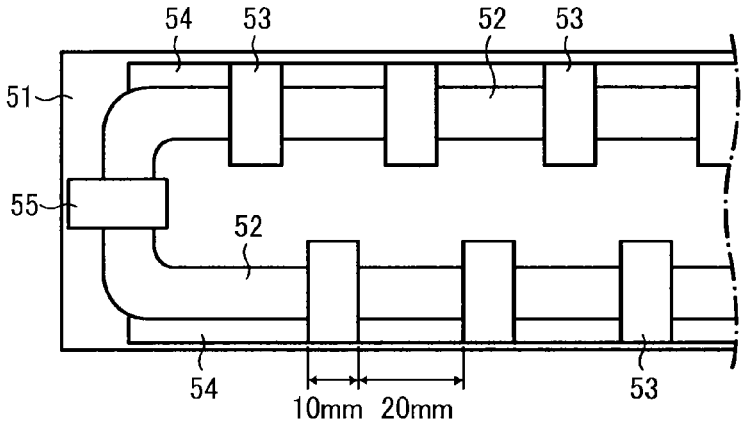
FIGS. 8A and 8B each illustrate an induction heating unit according to a third embodiment of the present invention.
Figure 8B:
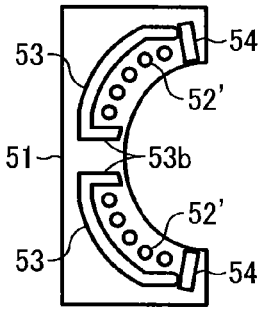

FIGS. 8A and 8B illustrate a third embodiment. In the third embodiment, the arch-shaped cores 53 are displaced in a staggered manner. Specifically, the plurality of arch-shaped cores 53 are arranged in two lines along each longitudinal side of the excitation coil 52 so that the arch-shaped cores 53 in one line are disposed in the staggered manner at different positions relative to the arch-shaped cores 53 in the opposite line. With this structure in which the arch-shaped cores 53 are displaced, the temperature distribution in the coil longitudinal direction can be smoothed.

In particular, if the heat roller 41 that serves as a heat generator in the present embodiment is produced using magnetic alloys, if each line of the arch-shaped cores 53 is disposed to oppose to each other (that is, not the staggered structure), heat is concentrated at the portion where the cores are disposed due to good magnetic coupling, resulting in uneven temperature distribution in the longitudinal direction. However, in the structure according to the third embodiment, because the arch-shaped cores 53 are displaced in the staggered manner, uneven distribution of the temperature in the longitudinal direction is suppressed, thereby obtaining the smoothed temperature distribution.

In the third embodiment, the shape of the end of the coil center portions 53*b* of the arch-shaped cores 53 may be either the one as illustrated in FIG. 7A according to the first embodiment and the other as illustrated in FIG. 7B according to the second embodiment, that is, the shape substantially parallel to the tangent line of the heat roller 41. In the example as illustrated in FIG. 8B, the shape according to the second embodiment is employed. In addition, the arch-shaped cores 53 each have a width of 10 mm and are disposed at intervals of 20 mm between adjacent cores.

Figure 9:
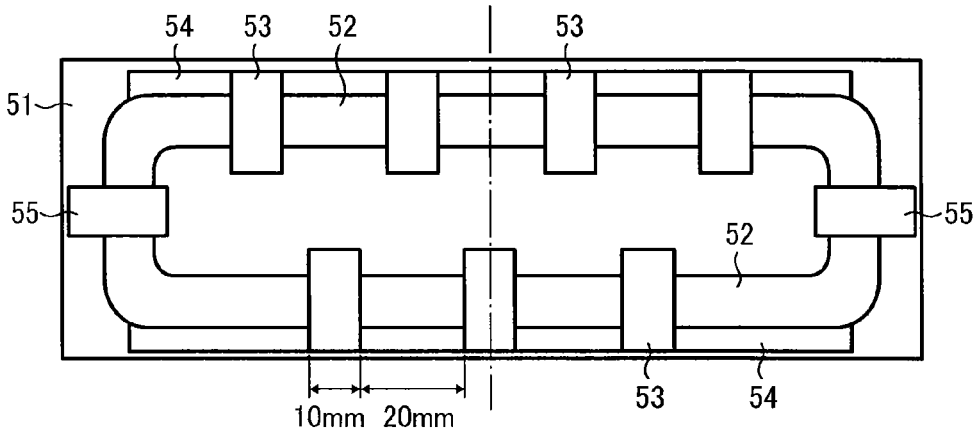
FIG. 9 is a schematic view illustrating an arch-shaped core entirely in its longitudinal direction.

FIG. 9 illustrates core arrangements in its entire longitudinal direction when the arch-shaped cores 53 are disposed in the staggered manner. However, FIG. 9 is an explanatory view of staggered disposition represented in a reduced size and number, and therefore, the actual number of the arch-shaped cores 53 is different. As illustrated in FIG. 9, the arch-shaped cores 53 in each line, that is, both sides of the coil or the upper and lower sides in the figure, are disposed by being displaced each other in the staggered manner.

[Fourth Embodiment]

Figure 10A:
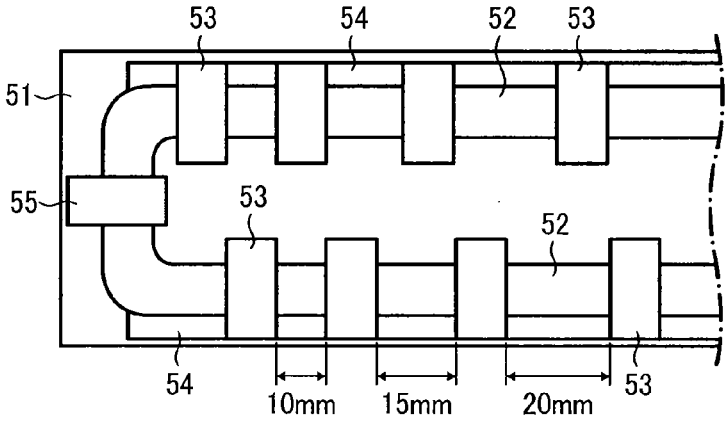
FIGS. 10A and 10B each illustrate an induction heating unit according to a fourth embodiment of the present invention.
Figure 10B:
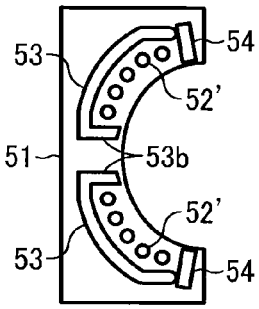

FIGS. 10A and 10B illustrate a fourth embodiment. As illustrated in FIG. 10A, the arch-shaped cores 53 are disposed denser in the end portion. Specifically, an interval or a pitch of the arch-shaped cores 53 is narrowed in the longitudinal end portions. In the illustrated example, the normal pitch size becomes sequentially narrower from 20 mm in the center to 15 mm and 10 mm. In the illustrated example, the pitch size is narrowed in two steps. The size down may be in more than three steps. Further, the pitch width may be variably set as needed.

Temperature tends to be decreased at an axial end portion of the heat roller 41 because heat dissipates outside. According to the present embodiment, by increasing the density of the arch-shaped cores 53 at both ends in the longitudinal direction, the temperature at the end of the heat roller 41 can be prevented from reducing.

In the fourth embodiment, the shape of the end of the coil center portions 53*b* of the arch-shaped cores 53 may be either the one according to the first embodiment and the other according to the second embodiment, that is, the shape substantially parallel to the tangent line of the heat roller 41. In the example as illustrated in FIG. 10B, the shape according to the second embodiment is employed.

[Fifth Embodiment]

Figure 11A:
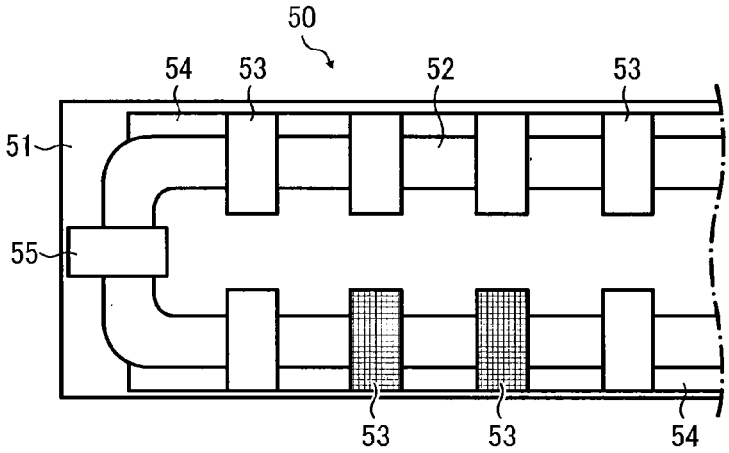
FIGS. 11A and 11B each illustrate an induction heating unit according to a fifth embodiment of the present invention.
Figure 11B:
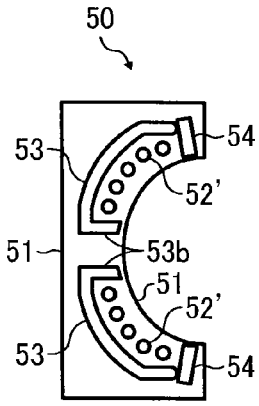

FIGS. 11A and 11B illustrate an induction heating unit according to a fifth embodiment. As illustrated in FIG. 11A, the arch-shaped cores 53 are configured such that a greater gap is provided between the side cores 54 and an inner wall of the unit case 51 facing the heat roller 41 side. It does not mean that a gap is given to all arch-shaped cores 53, but the arch-shaped cores 53 corresponding to a portion at which the temperature is higher in the temperature distribution along the nip portion in the heat roller axial direction are configured to be disposed farther from the heat roller 41 than the other arch-shaped cores 53.

Specifically, as illustrated in the cross-sectional view of FIG. 11B, the arch-shaped core 53 in the bottom is positioned farther leftward in the figure than the arch-shaped cores 53 positioned above so that the gap between the side core 54 and the inner wall of the unit case 51 becomes greater than that in the case of the upper arch-shaped core 53. As illustrated in FIG. 11A, the grated arch-shaped cores 53 are configured to have a greater gap. FIG. 11A represents an example in which two lower arch-shaped cores 53 are configured to have a greater gap than that of the other arch-shaped cores 53. The above structure is an example, and the arch-shaped cores 53 corresponding to a portion at which the temperature is higher in the temperature distribution along the nip portion in the heat roller axial direction are configured to be disposed with a greater gap from the heat roller 41 than that of the other arch-shaped cores 53.

With this structure according to the fifth embodiment, the temperature distribution in the axial direction of the heat generator can be smoothed.

In the fifth embodiment, the shape at the end of the coil center portions 53*b* of the arch-shaped cores 53 may be either the one according to the first embodiment and the other according to the second embodiment, that is, the shape substantially parallel to the tangent line of the heat roller 41. In the example as illustrated in FIG. 11, the shape according to the first embodiment is employed.

Figure 12A:
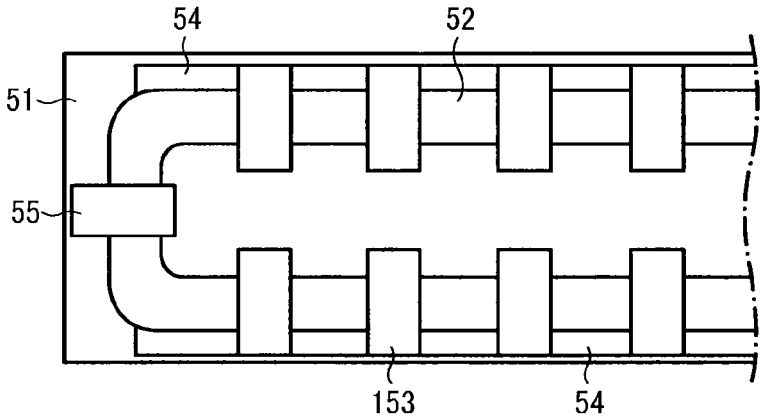
FIGS. 12A and 12B each illustrate an induction heating unit according to a first comparative example of the present invention.
Figure 12B:
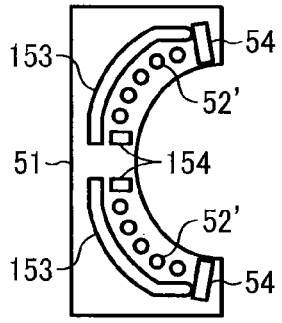

FIGS. 12A and 12B each illustrate an induction heating unit according to the first comparative example, which will be described later, of the present invention. In the embodiment as explained referring to FIG. 5A, the arch-shaped cores 53 include a continuous body formed of the arch-shaped portion 53*a* and the center portion 53*b* at an interior end side of the coil. On the other hand, in the comparative example 1 as illustrated in FIG. 5B, an arch-shaped core 153 and the center core 154 are divided. Except that the above portions are divided, the other structures are similar to the other embodiments.

In addition, in an experiment for comparison which will be described later, an induction heater mounted in the copier 'imagio C5000' (registered trademark; manufactured by Ricoh Company, Ltd.) is used as a comparative example 2.

The above comparative example 1 is appropriate to compare an effect of the arch-shaped core according to the present embodiment of the invention, in which the arch-shaped portion 53*a* and the center portion 53*b* are continuously provided. In addition, the comparative example 2 represents uniform temperature at the nip of an actual commercial product level and is effectively used for comparing the temperature distribution.

Hereinafter, a comparison experiment will be described.

In the comparison experiment, the above described actual printer (imagio C5000) is used, and the heating experiments have been done by sequentially changing the induction heater from the ones described in the first to fifth embodiments, the comparative example 1, and the comparative example 2. A temperature sensor is mounted upstream of the nip of the fixing unit and the temperature is obtained.

Figure 13:
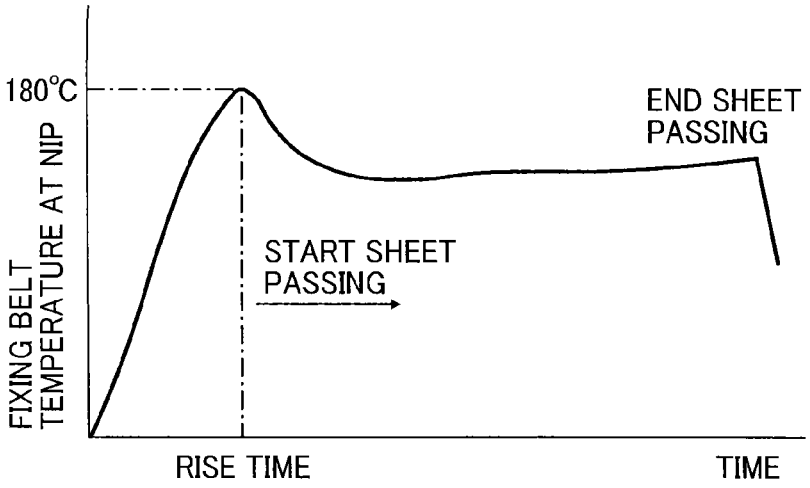
FIG. 13 is a graph for explaining details of a comparison experiment.

First, as illustrated in FIG. 13, the printer is turned on to increase the temperature of the fixing device up to 180 degrees C., that is a target fixing temperature to determine that the printer is ready for printing (that is, a start-up mode). When the obtained temperature has reached the target fixing temperature, the sheet is started to be conveyed. The sheet absorbs heat when the sheet conveyance is started, and the temperature decreases once but is recovered because the induction heater supplies thermal calories, and the temperature reduction stops. In the present experiment, time taken to raise the temperature up to the target fixing temperature of 180 degrees C. and the temperature distribution at the nip immediately before conveying the sheet are measured.

1) Elevated Temperature Experiment

Experiments are done using the induction heaters according to the comparative example 1 and the embodiments 1 and 2, so as to verify temperature increase when starting the temperature increase test.

Figure 14:
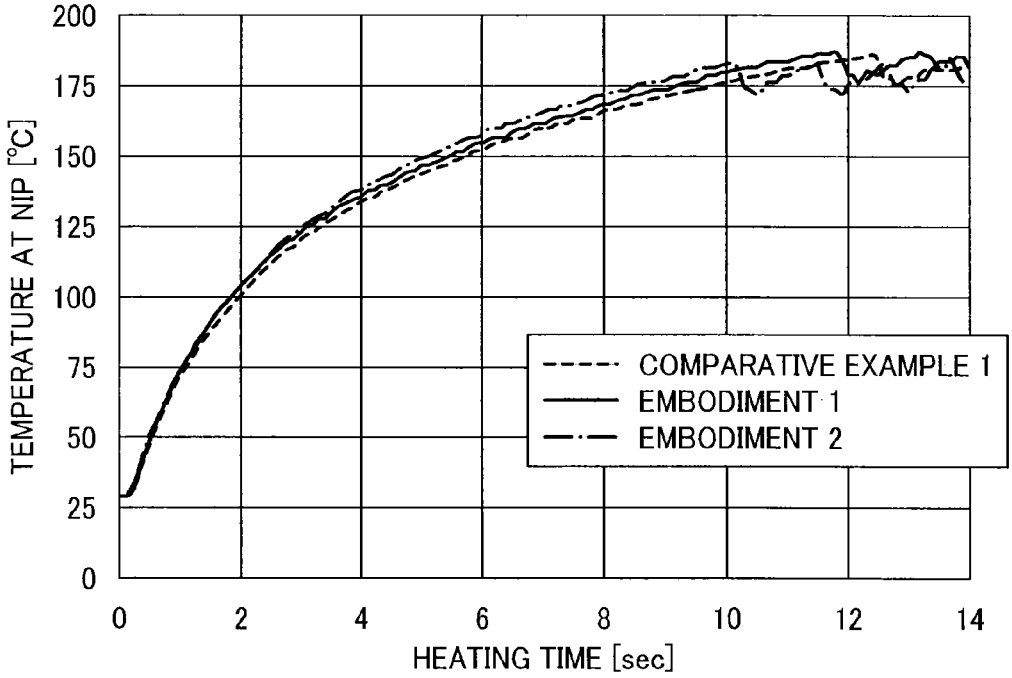
FIG. 14 is a graph showing results of temperature measurement at a center portion of the fixing unit in the comparative experiment.

FIG. 14 is a graph showing results of temperature measurement at a center portion of the fixing unit.

If comparing the comparative example and the first embodiment, it can be seen that the temperature increase is faster in the first embodiment. By using the arch-shaped core according to the present invention, the heat generation efficiency is improved and the temperature rise becomes faster.

If comparing the first embodiment and the second embodiment, it can be seen that the temperature increase is much faster in the second embodiment. From this result, it can be seen that the heat generation efficiency is improved when the leading end of the coil center portions 53*b* is shaped parallel to the heat generator.

From the above experiment of the temperature increase, it can be seen that the heat generation efficiency is improved by using the arch-shaped core according to the present invention.

2) Temperature Distribution in the Nip

Temperature distribution in the nip along the axial direction of the heat roller is measured, and it is verified whether or not the temperature distribution applicable to the fixing device may be actually obtained.

Figure 15:
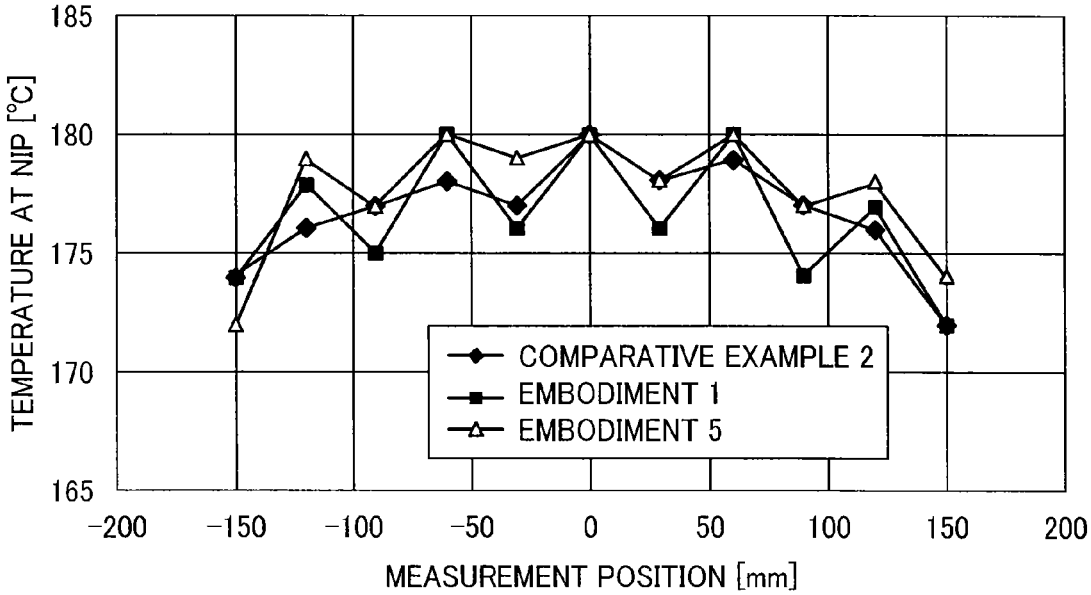
FIG. 15 is a graph showing temperature distribution at a nip portion of the second comparative example and the first and fifth embodiments.
Figure 16:
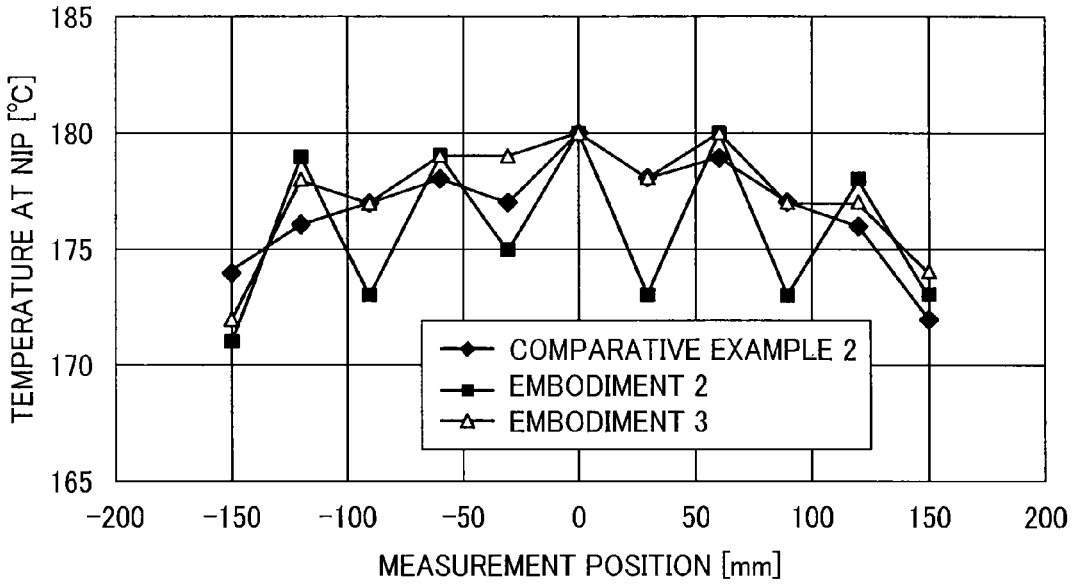
FIG. 16 is a graph showing temperature distribution at a nip portion of the second comparative example and the second and third embodiments.
Figure 17:
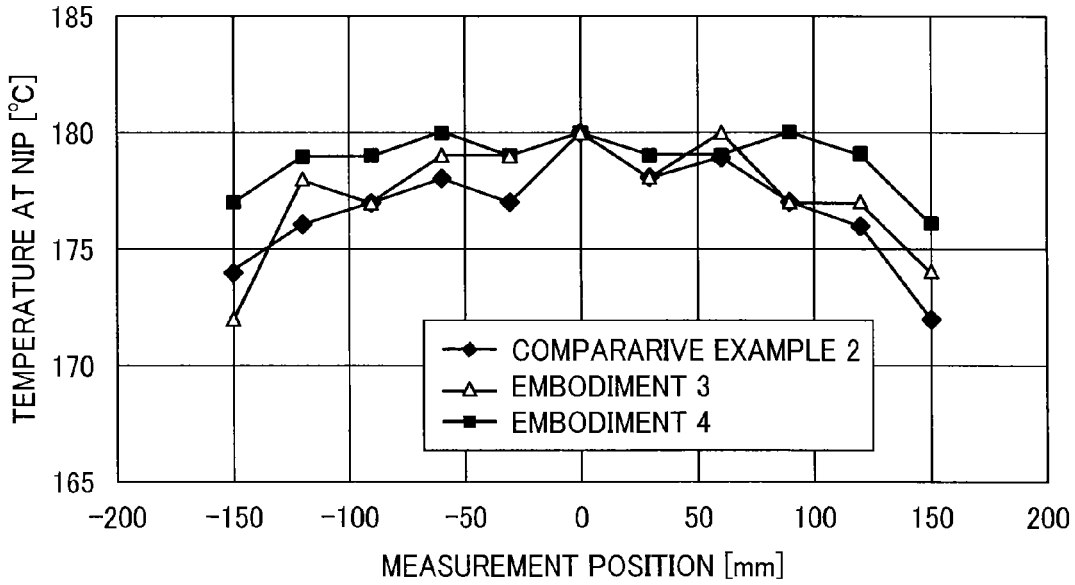
FIG. 17 is a graph showing temperature distribution at a nip portion of the third and fourth embodiments.

FIGS. 15 to 17 show temperature distributions of the comparative example and the present embodiments before the sheet conveyance. A vertical axis of the graph shows the position in the axial direction or sheet width direction, in which the center point is represented as "0". Allowable range of the temperature distribution is 10 degrees C. and therefore, the condition can be satisfied in any of the embodiments. Hereinafter, each embodiment will be explained in detail.

FIG. 15 shows comparison of the temperature distribution in the nip portion as to the comparative example 2 and the first and fifth embodiments. In the first embodiment, magnetic fluxes are concentrated at the arch-shaped cores 53, so that the rise and fall in the temperature distribution are large. In the fifth embodiment, because the temperature rise can be lowered by adjusting the gap of the arch-shaped cores 53, uniformity of the temperature distribution is improved.

FIG. 16 shows comparison of the temperature distribution in the nip portion as to the comparative example 2 and the second and third embodiments. In the second embodiment as well, magnetic fluxes are concentrated at the arch-shaped cores 53, so that the rise and fall in the temperature distribution are large. By contrast, because the arch-shaped cores 53 in the third embodiment are disposed in the staggered manner, the temperature distribution is smoothed. This is because the heat generation is made uniform by disposing the arch-shaped cores in the staggered manner.

FIG. 17 shows comparison of the temperature distribution in the nip portion of the comparative example 2 and the third and fourth embodiments. In the fourth embodiment, because the temperature decrease in both end portions is small, the temperature can be made uniform by adjusting intervals between cores.

As described above, the temperature distribution that can secure the fixabilty is obtained in the above embodiments and the uniformity of the temperature distribution can be improved.

As a result, by applying the present invention, leaked magnetic flux from the coil can be reduced and the heat generation property can be improved without degrading the uniformity of the temperature required for the nip portion of the fixing device, whereby the present invention can provide an optimal induction heating means excellent in the faster temperature rising when starting printing and an optimal image forming apparatus with an excellent energy saving property.

Finally, a description will be given of the sixth embodiment of the present invention in which the present invention is applied to the fixing device employing a heat roll method.

Figure 18:
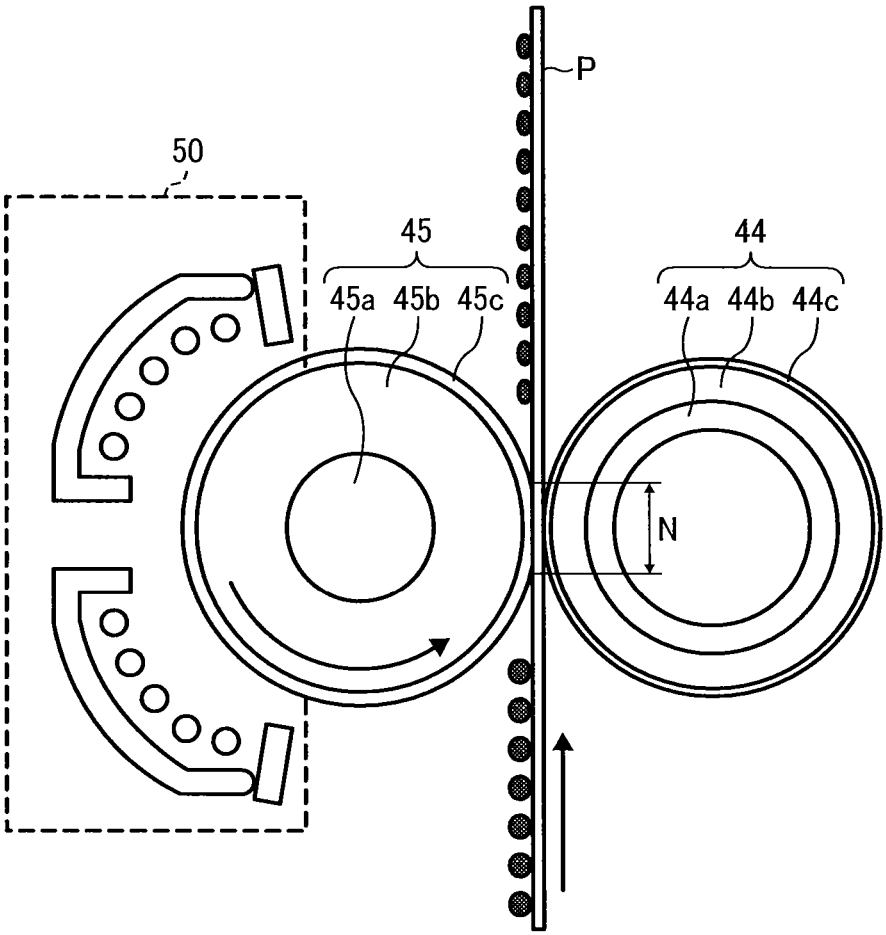
FIG. 18 illustrates a fixing device according to a sixth embodiment in which the present invention is applied to a fixing device employing a heat roll method.
Figure 19:
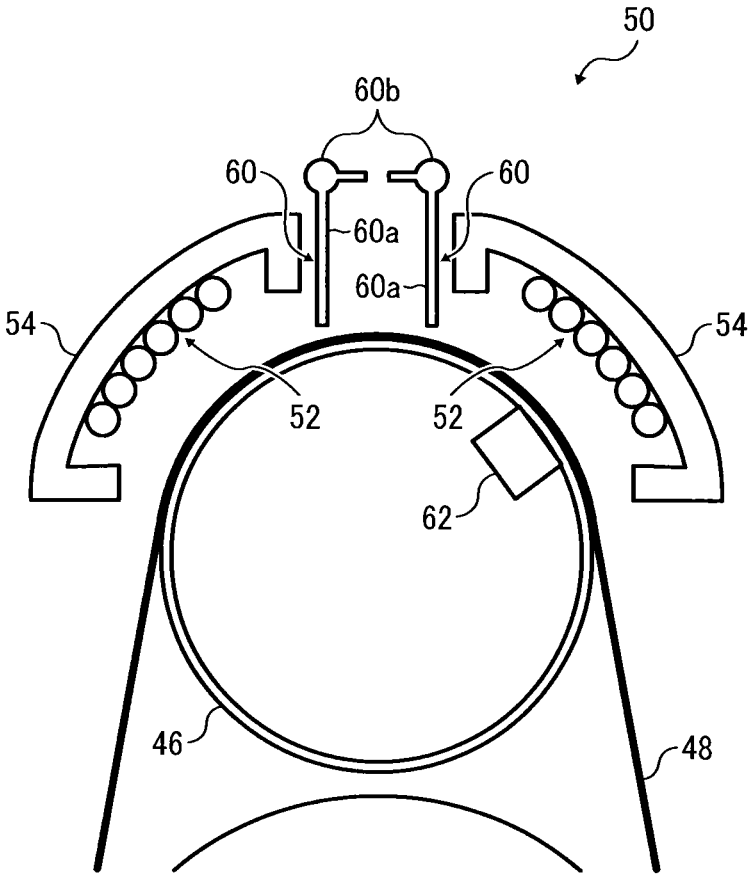
FIG. 19 BACKGROUND ART
FIG. 19 illustrates a drawing for one of the background art references.

FIG. 18 shows a fixing device including a fixing roller 45 serving as a fixing member and the induction heating unit 50 which heats the fixing roller 45. In the structure according to the sixth embodiment, the fixing roller 45 serves as the fixing member and also as the heat generation member, because the fixing roller 45 is heated by the induction heating unit 50 and generates heat.

The structure and operation of the induction heating unit 50 which is used in the sixth embodiment are the same as those explained in the first embodiment, and therefore, the redundant description thereof will be omitted.

Specifically, the fixing roller 45 has an outside diameter from 30 to 40 mm and includes an elastic layer 45*b*, a heat generation layer 45*c*, and a release layer (not shown) are laminated on a metal core 45*a*. The fixing roller 45 rotates in a direction as indicated by an arrow in the figure, i.e., in a counterclockwise direction, is heated by induction heating, and fuses the toner image carried on a recording sheet, to be conveyed to the fixing nip portion.

As described above, the fixing device according to the present invention includes arch-shaped cores 53 having ends 53*b* disposed at inner sides of the excitation coil 52 bent toward the side of the fixing member or the heat generator; and opposite side ends 53*c* each extending to the side cores 54 without interfering with the excitation coil 52. As a result, without increasing the number of parts for producing the core, heat generating efficiency can be improved. In addition, the end portion opposite the bent portion is not bent toward the fixing member, so that centralization of heat is eliminated and uneven temperature along the longitudinal direction of the heat generator can be suppressed. Further, because the end of the arch-shaped cores do not interfere with the excitation coil in assembling operation, thereby not degrading workability in assembling.

Further, because the leading end of the arch-shaped core is substantially parallel to the tangent line of the fixing member or the heat generator, magnetic fluxes from the arch-shaped core leading to the fixing member (heat generator) can be increased and the heating efficiency can be improved.

Furthermore, the plurality of arch-shaped cores are arranged in two lines along each longitudinal side of the excitation coil so that the arch-shaped cores in one line are disposed in the staggered manner at different positions relative to the arch-shaped cores in the opposite line. With this structure, the temperature distribution in the longitudinal direction of the excitation coil can be smoothed.

Furthermore, the plurality of arch-shaped cores is disposed denser in the end portions in the longitudinal direction of the excitation coil than in the center portion. Thus, the temperature at the end of the fixing member (heat generator) can be prevented from reducing.

Further, the gap between each arch-shaped core and the side core is adjusted so that the elevated heat distribution along the axial direction of the rotary fixing member is smoothed, whereby occurrence of uneven temperature in the fixing member axial direction can be prevented.

In addition, the present invention can be applied to both the fixing device employing the belt fixing method and that employing the heat roll method.

The present invention may also be applied to, not limited to the copier, a printer, a facsimile machine, or a multi-function apparatus having one or more capabilities of the above devices.

Additional modifications and variations of the present invention are possible in light of the above teachings. It is therefore to be understood that, within the scope of the appended claims, the invention may be practiced other than as specifically described herein.

What is claimed is:

1. A fixing device comprising:

a rotary fixing member having an axial direction;

a pressure roller pressed against the fixing member to form a nip in association with the fixing member; and an induction heater, as a heat source, to heat the fixing member, wherein the induction heater comprises:

an excitation coil to induction-heat the fixing member;

plural side cores disposed along an outer circumference in a longitudinal direction of the excitation coil, a length of the side cores extending in the axial direction of the rotary fixing member; and a plurality of arch-shaped cores disposed to cover the excitation coil in the longitudinal direction of the excitation coil, the plurality of arch-shaped cores spaced along the longitudinal direction of the excitation coil, the plural side cores magnetically connecting the plurality of arch-shaped cores, wherein the arch-shaped cores include:

center portions corresponding to an inner side of the excitation coil and bent toward the fixing member; and outer end portions extending in the direction leading to the side cores without interfering with the excitation coil, wherein the center portions of the arch-shaped cores and corresponding ones of the outer end portions of the arch-shaped cores are a continuous body, and wherein the plural side cores are longer than a width of the plurality of arch-shaped cores.

2. The fixing device as claimed in claim 1, wherein an end of at least one of the center portions of the arch-shaped core is substantially parallel to a tangent line of the rotary fixing member.

3. The fixing device as claimed in claim 1, wherein the plurality of arch-shaped cores are staggered in two opposite lines along the longitudinal side of the excitation coil.

4. The fixing device as claimed in claim 1, wherein the plurality of arch-shaped cores are disposed denser in the end portions in the longitudinal direction of the excitation coil than in the center portion.

5. The fixing device as claimed in claim 1, wherein relative positions of each arch-shaped core and the side cores are disposed so that heat distribution along the axial direction of the rotary fixing member is made uniform.

6. The fixing device as claimed in claim 1, further comprising:

a fixing roller; and a support roller as a heat generator heated by the induction heater, wherein the rotary fixing member is an endless belt wound around the fixing roller and the support roller.

7. The fixing device as claimed in claim 1, wherein the rotary fixing member functions as a fixing roller, and the fixing roller is a heat generator heated by the induction heater.

8. An image forming apparatus comprising a fixing device as claimed in claim 1.

9. The fixing device as claimed in claim 1, wherein the center portions of the arch-shaped cores and corresponding ones of the outer end portions of the arch shaped cores are integral.

10. The fixing device as claimed in claim 1, wherein the center portions of the arch-shaped cores and corresponding ones of the outer end portions of the arch shaped cores prevent a leak of magnetic flux.

11. The fixing device as claimed in claim 10, wherein the center portions of the arch-shaped cores and corresponding ones of the outer end portions of the arch shaped cores cause the magnetic flux to be transmitted completely.

12. The fixing device as claimed in claim 1, wherein the center portions of the arch-shaped cores and corresponding ones of the outer end portions of the arch shaped cores are integrally formed.

* * * * *